United States Patent [19]

Kellett

[11] 4,044,964

[45] Aug. 30, 1977

[54] ROLL HOLDER FOR PHOTOGRAPHIC PROCESSORS

[75] Inventor: William B. Kellett, Minneapolis, Minn.

[73] Assignee: Pako Corporation, Minneapolis, Minn.

[21] Appl. No.: 720,979

[22] Filed: Sept. 7, 1976

[51] Int. Cl.[2] ..... B65H 19/08

[52] U.S. Cl. ..... 242/58; 242/55.3

[58] Field of Search ..... 242/58, 55.3, 56.9, 242/68, 129.6; 248/286

[56] References Cited

U.S. PATENT DOCUMENTS

| | | | |
|---|---|---|---|
| 731,123 | 6/1903 | Owen | 242/68 |
| 1,704,614 | 3/1929 | Johnston | 242/68 |
| 2,450,496 | 10/1948 | Whiteley | 242/55.3 X |

*Primary Examiner*—Edward J. McCarthy
*Attorney, Agent, or Firm*—John W. Adams

[57] ABSTRACT

An adjustable roll holding rack particularly designed to facilitate width adjustment and loading in a dark room atmosphere and including a pair of adjustable roll holding brackets each having a generally G-shaped spindle receiving slot for journalling in captured relationship the roll mounting pins on which the supply rolls of strip material to be processed are carried and each bracket being provided with a wide mouth entrance leading into said slot to guide the spool spindle into the slot for easy loading in the dark room atmosphere, said brackets also including supporting arms adapted to be securely anchored in the desired adjusted spaced apart relation to accommodate rolls of different widths of strip material, with means for releasably holding the brackets in the desired adjusted position.

8 Claims, 3 Drawing Figures

ROLL HOLDER FOR PHOTOGRAPHIC PROCESSORS

BACKGROUND OF THE INVENTION

With present day high speed processing equipment it is necessary to provide a roll holding device which is particularly adapted to facilitate quick and easy dark room loading of the supply rolls while also facilitating adjustment thereof to accommodate rolls of different width materials.

SUMMARY OF THE INVENTION

The specific invention disclosed herein constitutes a dark room loader for holding rolls of photographic strip material to be processed which loader includes a pair of roll holding brackets mounted for quick and easy adjustment of the spacing therebetween and which are particularly designed to facilitate dark room loading of the supply rolls thereon by providing pin receiving slots having guiding approach surfaces leading into the slots whereby the roll mounting pins of the supply rolls may be inserted into the slots by a blind operator or in a dark room atmosphere.

DESCRIPTION OF THE DISCLOSED EMBODIMENT

Figure 1:
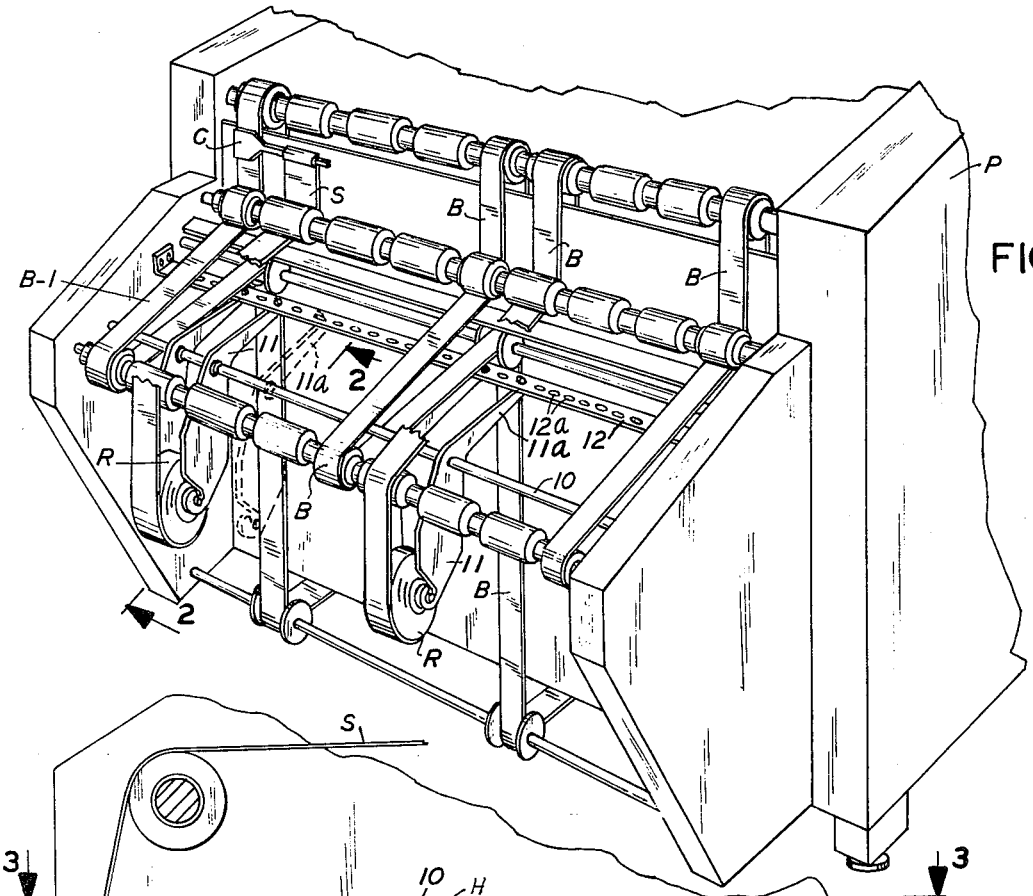
FIG. 1 is a perspective view showing the loading end of a processing machine which embodies this invention.

FIG. 1 shows the loading or supply end of a photographic processor such as a paper processor P. A plurality of conveyor or leader belts B are shown which are designed to transport strips of film S through the processor. The strips are anchored to the belt by cantilevered support clips C which are attached to the leader belt by the operator in a conventional manner.

The processor P is provided with a mounting bar 10 on which a plurality of spool holding brackets 11, having hub elements H, are slidably and rotatably mounted to permit the spacing therebetween to be easily adjusted. Anchoring means for positively holding each of the brackets in the desired spaced apart relation are provided. These anchoring means include an apertured anchoring bar 12 mounted in fixed rearwardly spaced parallel relation to the mounting bar 10. Each of the brackets has an anchoring arm **11*a* extending rearwardly therefrom with a locking hook 11*b* formed on the inner end thereof which is adapted to be received in a selected aperture 12*a* of the anchoring bar 12**.

Figure 2:
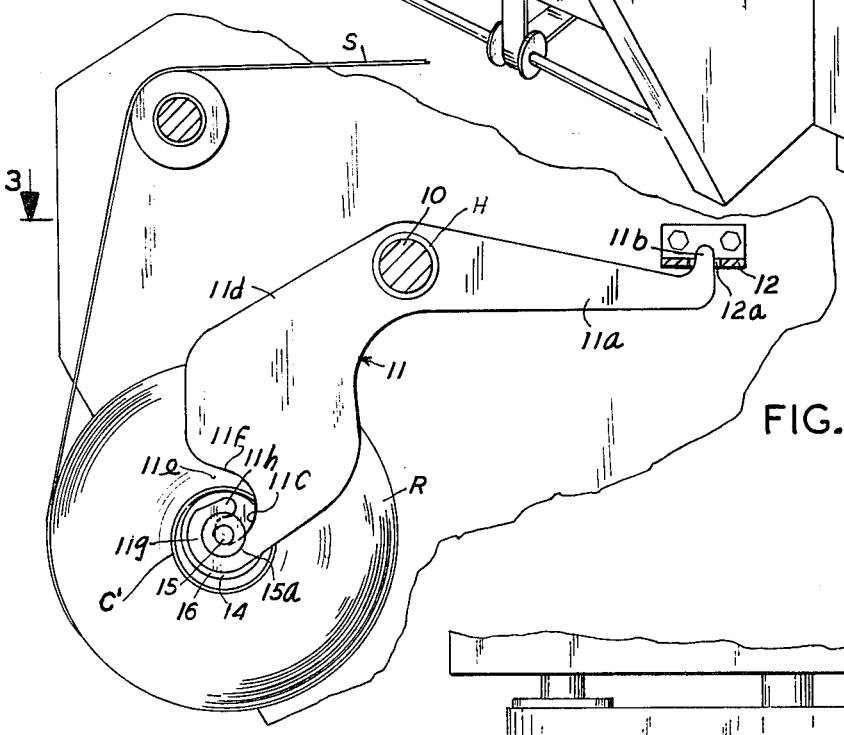
FIG. 2 is a fragmentary sectional view taken substantially along the line 2—2 of FIG. 1.
Figure 3:
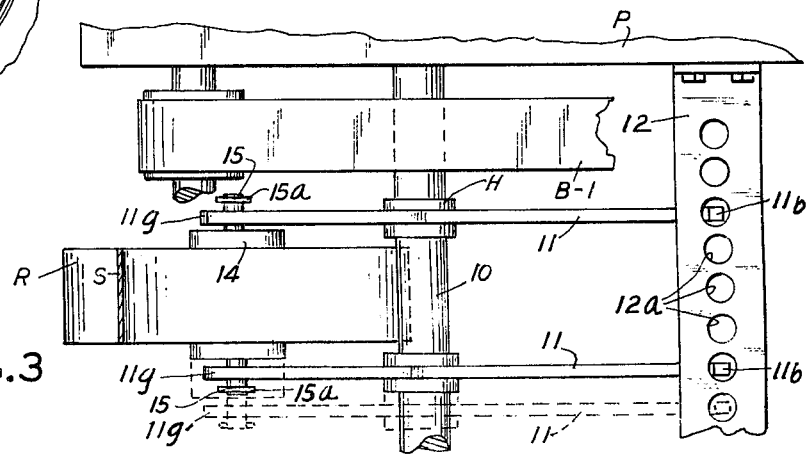
FIG. 3 is a fragmentary top plan view of one pair of spool mounting brackets embodying the invention.

The supply rolls of strip material R, such as exposed photographic print paper, are mounted on mounting spools 14 having mounting pins or spindles 15 fixed to the ends thereof. The rolls R are mounted on a suitable core element C', the inside diameter of said core being somewhat larger than the outside diameter of the spool 14 as best shown in FIG. 2. Each of the mounting pins 15 has a retaining flange **15*a* on the outer portion thereof to positively prevent the outer ends of the pins 15 from sliding out of G-shaped mounting slots 11*c* formed in the outwardly extending mounting arms 11*d* of the brackets 11. Each slot 11*c* has a relatively wide mouth entrance opening 11*c* and a sloping guiding surface 11*f* leading into the lower mounting portion 11*g* thereof. The width of said mounting portion 11*g* is slightly less than the width or outer diameter of the flange 15*a* of each mounting pin 15 as best shown in FIGS. 2 and 3. The G-shape of said slot provides an upper overhanging retaining 11*h* element 11h as best shown in FIG. 2 which positively retains and captures the flanged spindles 15 therein during the dispensing of the strip material S from the supply rolls R. It will be noted that the mass of the mounting arm 11*d* of each bracket is substantially greater than the mass of the rearwardly extending anchoring arm so that the weight of mounting arm 11*d* positively holds the locking hook 11*b*** in its selected aperture.

The leader clips C are initially attached to the leading end of the strips S in a conventional manner and are thereafter applied to the loading portion B-1 of the leader belts B which are in most cases in continuous operation into the processor. It must be kept in mind that this entire roll mounting and clip attaching operation is conducted by feel by a blind person or in a dark room atmosphere. It is, therefore, essential that the mounting pins 15 with a roll R mounted thereon can be quickly and easily inserted through the entrance **11*e* and down into the mounting portions 11*g* of the slots in each pair of adjacent brackets 11**. It is also essential that the spaces between adjoining brackets be quickly and easily adjustable for rolls of different width materials.

The wide mouth **11*e* entering into the G-shaped slot 11*g* and the sloping surfaces 11*f*** combine to facilitate the loading of the rolls in the brackets without requiring the operator to actually see the operation.

The slidable and rotatable mounting of the brackets on the stationary mounting bar 10 permits the locking hook **11*b* to be quickly and easily removed from its aperture 12*a* in the anchoring bar 12 and shifted into the desired adjusted position on the adjustment bar 10**, and thereafter re-anchored in the aligned aperture.

It will be seen that this invention provides an adjustable dark room loading rack which greatly facilitates the loading of rolls of photographic material in a processing machine in a dark room atmosphere while also permitting quick and easy adjustment of the spacing between the mounting bars to accommodate strips of varying widths.

It will, of course, be understood that various changes may be made in the form, details, arrangement and proportions of the parts without departing from the scope of this invention, which generally stated is set forth in the appended claims.

What is claimed is:

1. A roll holder for mounting supply rolls of photographic strip material to be processed, said holder comprising:

- a transversely extending fixed mounting rod,
- a fixed adjustment element spaced rearwardly from said mounting rod,
- a pair of laterally extending roll mounting pin elements for journaling a supply roll of photographic strip material to be processed,
- a pair of spaced apart roll holding brackets, each bracket including:
  - a hub element rotatably and slidably mounted on said transverse mounting rod,
  - a roll mounting arm fixed to said hub element and extending forwardly therefrom,
  - an anchoring arm fixed to said hub element and extending rearwardly therefrom and having an interlocking element adjustably connected to said adjustment element to anchor the bracket in the desired spaced apart from the other bracket of said pair, said roll mounting arm including a pin receiving slot oriented to rotatably mount in captured relationship the mounting pins on which a roll of strip material to be processed is carried.

2. The structure set forth in claim 1 and said fixed adjustment element having a plurality of spaced apart apertures for selectively receiving the interlocking element of said anchoring arm and extending transversely in spaced parallel relation to said mounting rod, and said interlocking element comprising an upwardly extending hook fixed to the rear portion of said anchoring arm and adapted to be upwardly received in a selected aperture in said ajustment element to positively hold the forwardly extending mounting arm in the desired selected laterally adjusted position on the mounting rod.

3. The structure set forth in claim 2 and releasable means for holding said hook in said selected aperture.

4. The structure set forth in claim 3 wherein said releasable means constitutes a forwardly extending roll mounting arm of sufficient weight to hold the interlocking hook of the anchoring arm in the selected aperture of said adjustment element during dispensing of the strip material from the roller.

5. The structure set forth in claim 1 and said pin mounting slot being generally G-shaped with a forwardly facing entrance opening at the upper portion thereof and a forwardly closed retaining slot portion in the lower portion thereof to produce the pin capturing relationship required to hold the roll mounting pins in said brackets.

6. The structure set forth in claim 5 and said slot having an enlarged entrance opening to facilitate dark room loading of the laterally extending pin elements in said slots.

7. The structure set forth in claim 1 and said laterally extending pins having retaining elements on the ends thereof, said retaining elements being of greater width than the width of the mounting portion of each slot.

8. The structure set forth in claim 7 and said retaining elements constituting generally circular flange elements of greater diameter than the width of the mounting portion of each slot.

* * * * *